US005810685A

United States Patent [19]

Willner et al.

[11] Patent Number: 5,810,685

[45] Date of Patent: Sep. 22, 1998

[54] PRACTICE BALL WITH SOUND AND ACCELERATION SENSOR

[76] Inventors: LeRoy Frederick Willner, 7204 Oldgate Rd., Rockville, Md. 20852; Roger Edwin Fitzgerald, 18006 Marshall Mill Rd., Hampstead, Md. 21074

[21] Appl. No.: 612,066

[22] Filed: Mar. 7, 1996

[51] Int. Cl.[6] ..... A63B 67/10; A63B 37/00

[52] U.S. Cl. ..... 473/571; 473/576; 473/506; 273/335

[58] Field of Search ..... 473/571, 575, 473/576, 506, 601, 602; 273/317.2–317.8, 374, 335, DIG. 17, DIG. 19; 446/175; 340/323 R; 364/410

[56] References Cited

U.S. PATENT DOCUMENTS 4,561,661 12/1985 Walker et al. .
4,576,379 3/1986 Juhasz .
4,577,865 3/1986 Shishido ..... 473/571
4,595,200 6/1986 Shishido .
4,706,964 11/1987 Genovese .
5,049,107 9/1991 DeNittis .
5,083,797 1/1992 Vartija et al. .
5,236,383 8/1993 Connelly .
5,260,512 11/1993 Chomette et al. .
5,280,843 1/1994 Vartija et al. .
5,358,258 10/1994 Killion .
5,375,839 12/1994 Pagani ..... 473/571

*Primary Examiner*—Jessica Harrison
*Assistant Examiner*—Mark A. Sager
*Attorney, Agent, or Firm*—Jacobson, Price, Holman & Stern, PLLC

[57] ABSTRACT

A practice ball responsive to acceleration for use in practicing sports and an acceleration sensor therefor. The practice ball includes an electronics housing; an acceleration sensor mounted in the electronics housing and responsive to acceleration of the practice ball; a sound generating device also mounted in the electronics housing and responsive to the acceleration sensor; and a soft deformable shell having a shape which simulates a sports ball. The soft deformable shell, which is capable of snugly accommodating the electronics housing, may be supported by a tether line connected to the electronics housing. The acceleration sensor preferably includes at least two switching elements, each of which is responsive to a different magnitude of acceleration. The sound generating device is then responsive to the switching elements so as to emit different programmed sounds depending on which of the switching elements is/are actuated by acceleration of the practice ball. The different programmed sounds may include verbal messages from a voice simulation device in the sound generating device. Preferably, the practice ball is a soft, foam soccer ball for use in practicing the art of heading a soccer ball.

27 Claims, 4 Drawing Sheets

PRACTICE BALL WITH SOUND AND ACCELERATION SENSOR

BACKGROUND OF THE INVENTION

The present invention relates to a ball capable of emitting different sounds in response to different accelerations, for use in sports training especially in practicing the art of heading of a ball important in playing the sport of soccer, also known elsewhere in the world as football. The present invention also relates to an acceleration sensor capable of detecting at least two different magnitudes of acceleration.

There are many known practice devices for improving one's skills at a sport such as soccer including devices for training in heading soccer balls. The following are several examples of soccer practice devices:

| Patent No. | Patentee |
|---|---|
| 4,561,661 | Walker et al. |
| 4,576,379 | Juhasz |
| 4,706,964 | Genovese |
| 5,083,797 | Vartija et al. |
| 5,280,843 | Vartija et al. |
| 5,358,258 | Killion |

In addition, there are several patented ball-shaped toys which include sound-generating devices for emitting sounds when keys on the outer surface of the device are manually activated. The following are examples of such ball-shaped toys:

| Patent No. | Patentee |
|---|---|
| 5,049,107 | De Nittis |
| 5,260,512 | Chomette et al. |

None of the foregoing devices, however, provides a practice or training ball capable of emitting a programmed sound in response to the impact imparted to the ball by the practicing or training person. Moreover, none of the foregoing devices provides a practice ball capable of emitting different sounds in response to different magnitudes of impact imparted to the ball upon being struck. More particularly, none of the prior art devices when tethered for training the art of soccer heading are capable of emitting a programmed sound depending upon the impact characteristics delivered to the tethered ball by the practicing person. An arrangement capable of performing these functions would be extremely useful for indicating to an athlete whether a simulated ball was struck with sufficient force to a achieve a desired acceleration of the ball, especially in training proper heading of a soccer ball.

SUMMARY OF THE INVENTION

A primary object of the present invention is to overcome the deficiencies in the prior art training devices, especially tethered training balls, by providing a practice ball capable of emitting a programmed sound or sounds in response to the impact imparted to the ball upon being struck.

Another object of the present invention is to provide a practice ball capable of emitting different programmed sounds in response to different magnitudes of impact imparted to the ball.

A further object of the present invention in accordance with the foregoing objects is to provide a practice ball which measures impact based upon the amount of acceleration imparted to the practice ball by the training person and to emit a programmed sound or verbal message characteristic of the amount of measured acceleration.

A still further object of the present invention is to provide a tethered ball simulating a soccer ball for training the art of soccer heading which is capable of emitting a programmed sound depending upon the impact characteristics delivered to the tethered ball by the practicing person.

Yet another object of the present invention is to provide an impact sensing mechanism for use in a practice ball, specifically in acceleration sensor, which is responsive to at least two different magnitudes of acceleration.

Still yet another object of the present invention is to provide a compact housing assembly for mounting the impact sensor, sound emitting speaker and related components to be inserted and retained in the practice ball in accordance with the preceding objects.

Still a further object of this invention is to provide a programmed sound emitting practice ball in accordance with the preceding objects which will be of simple construction, readily manufactured from available components, and easy to use so as to provide a device that will be economically feasible, long lasting, and relatively trouble free in operation.

The above and other objects are achieved by the practice ball and impact sensor of the present invention. The practice ball includes an electronics housing, an impact sensor in the form of an acceleration sensor mounted to the electronics housing which is responsive to acceleration of the practice ball, a sound generating mechanism mounted to the electronics housing and responsive to the acceleration sensor for emitting at least a first sound in response to a first predetermined minimum amount of acceleration, and a soft shell having a shape which simulates a sports ball, preferably a soccer ball, and capable of accommodating the electronics housing.

Preferably, the simulated sports ball is a ball of deformable cellulous material, such as polyurethane foam or the like, and has a cavity in its outer surface to receive the electronics housing therein. The housing and the cavity are preferably dimensioned such that the electronics housing fits snugly within the cavity and is retained in the cavity by the frictional engagement of the housing exterior walls and the deformable walls of the cavity. In addition, the surface of the electronics housing facing outwardly preferably has an open-cell cellulous covering which matches the spherical shape of the ball outer surface.

The impact sensor in accordance with the present invention is an acceleration sensor which preferably includes at least two switching elements, each of which is responsive to a different magnitude of acceleration. The sound generating mechanism is responsive to the switching elements so as to emit different programmed sounds or verbal messages depending on which of the switching elements is/are actuated.

Preferably, the acceleration sensor includes a conductive frame member having holes therein and electrically connected to the sound generating mechanism. The switching elements include springs, each of the springs having a distal end disposed through a respective one of the holes in the conductive frame member and a fixed proximal end electrically connected to the sound generating mechanism. The holes in the conductive frame member and the springs are arranged with respect to one another so that the springs make electrical contact with the conductive frame member only in response to different magnitudes of acceleration. Preferably, the springs are substantially parallel to one another and responsive to acceleration in any direction which is orthogonal to a longitudinal axis of each spring.

The sound generating mechanism is responsive to electrical contact between the springs and the conductive frame member so as to produce different programmed sounds according to which of the springs makes the electrical contact with the conductive frame member. Preferably, the sound generating mechanism includes a voice simulation device and the different sounds are verbal messages.

In the preferred form of the invention, the practice ball simulates a soccer ball and includes a tether line preferably connected directly to the electronics housing so that the electronics housing is supported by the tether line. When the tether line is so connected, the tether line supports the soft deformable ball by virtue of the snug fit of the electronics housing in the cavity of the ball. The acceleration sensor is adapted to distinguish between accelerations associated with an improperly headed soccer ball and accelerations associated with a properly headed soccer ball. The verbal messages are then selectively emitted depending on whether the accelerations correspond to a properly headed soccer ball or an improperly headed soccer ball.

The foregoing, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
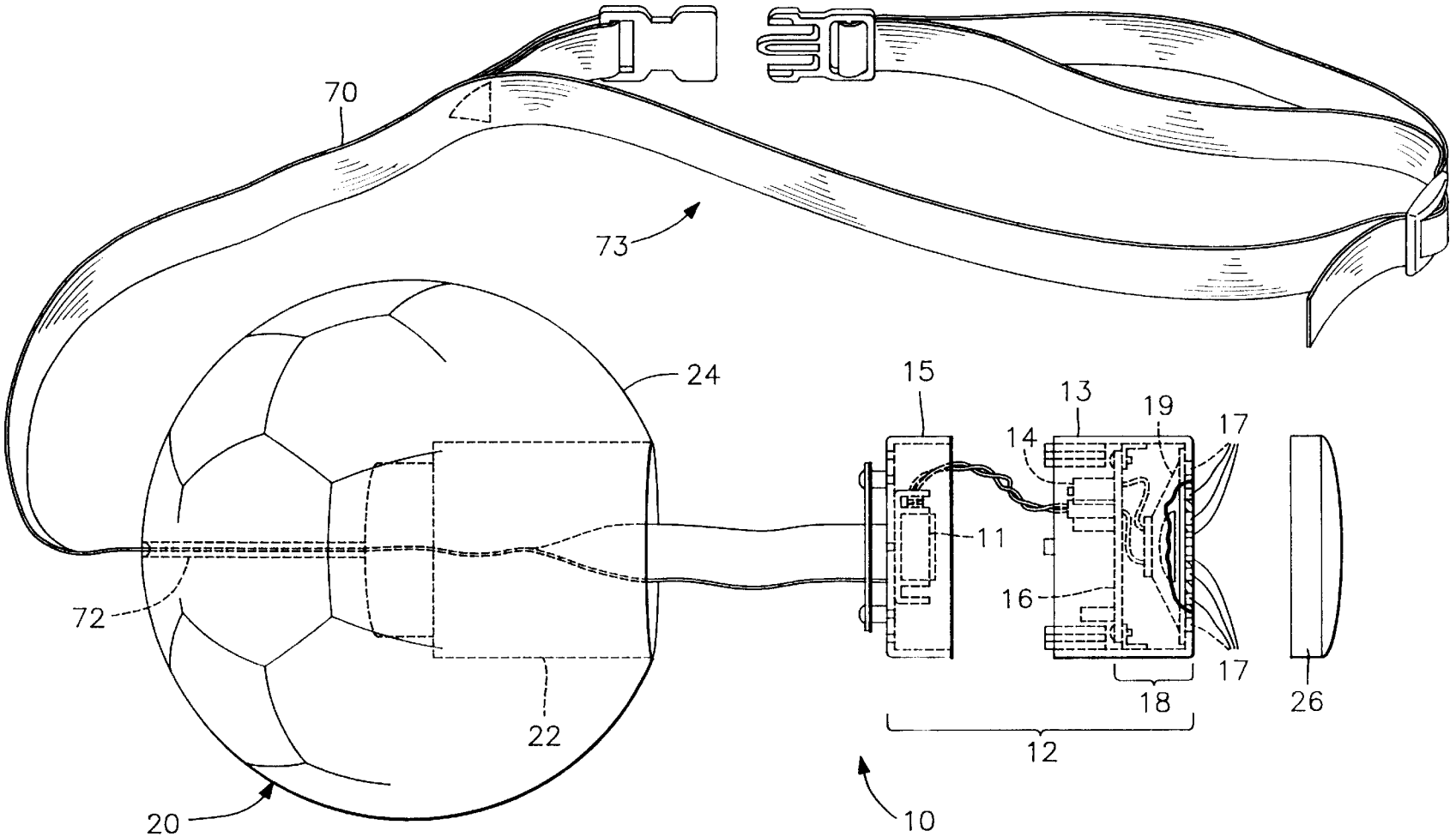
FIG. 1 is an exploded view of a preferred practice ball according to the present invention.

In describing the preferred embodiments of the invention as illustrated in the drawings and otherwise, specific terminology will be resorted to for the sake of clarity. However, the invention is not intended to be limited to the specific terms so selected, and is to be understood that each specific term includes all technical equivalents which operate in a similar manner to accomplish a similar purpose.

With reference to FIGS. 1–6, a preferred embodiment of a practice ball 10 for use in practicing sports, particularly for practicing the heading of soccer balls, will now be described.

As FIG. 1 illustrates, the practice ball 10 includes an electronics housing 12; an impact sensor 14, preferably an acceleration sensor, mounted to the electronics housing 12 via a circuit board 16; a sound generating mechanism 18 mounted to the electronics housing 12 and which includes the circuit board 16 and a speaker 19; and a soft shell 20 having a shape which simulates a sports ball, and capable of accommodating the electronics housing 12.

While an acceleration sensor is the preferred embodiment for the impact sensor 14 and an acceleration sensor will be described further hereinafter, it will be appreciated by those skilled in the art that other impact sensing mechanisms can be designed and incorporated in accordance with the present invention. It should be appreciated that the sensing mechanism should sense a minimum level of impact and distinguish between at least a poor heading impact and a good heading impact in order to serve as a valuable training aid in the art of heading a soccer ball in accordance with the present invention.

Preferably, the soft shell 20 for the simulated sports ball is made of a deformable cellulous material having a cavity 22 extending through an outer surface 24 of the ball. The cavity 22 is preferably dimensioned such that the electronics housing 12 fits snugly and remains frictionally retained therein. Although the preferred embodiment of the soft shell 20 is made from a polyurethane foam having a closed-cell structure and having a density of approximately 3.5 pounds per cubic foot, it is understood that many other similarly resilient materials may be utilized. Preferably, the soft shell 20 simulates a soccer ball and has a diameter of approximately 7.5 inches.

The cavity 22 is sufficiently deep to permit retention of the electronics housing 12 well below the outer surface 24 of the soft shell. The void left between the outer surface 24 and the electronics housing 12 is preferably filled using a cellulous foam cover 26 having an outer shape which matches the spherical shape of the outer surface 24. Preferably, the cellulous foam cover 26 has an open-cell structure so that sound passes more easily through the cover 26 from the sound generating mechanism 18.

Figure 2:
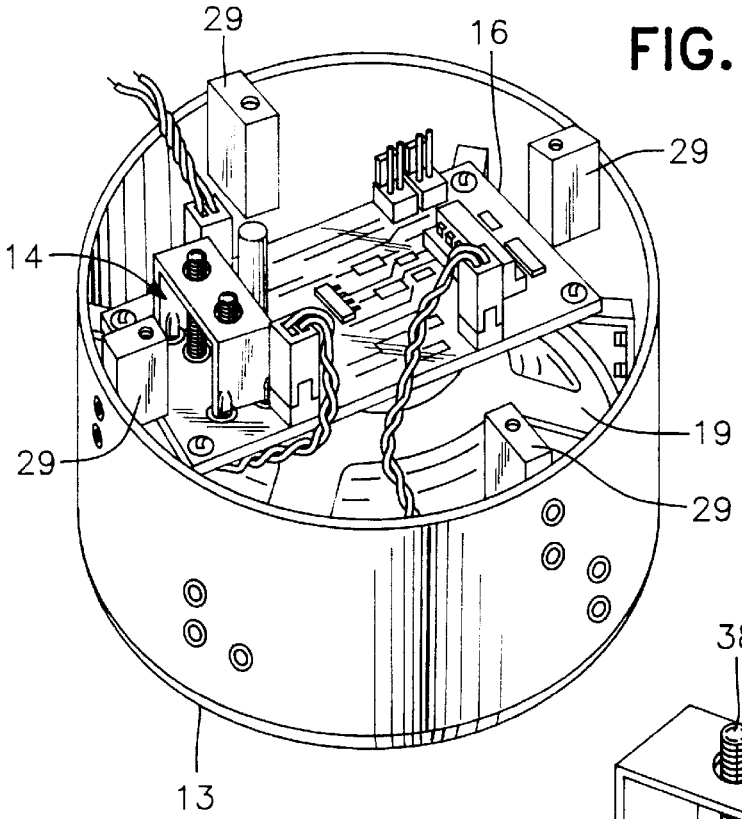
FIGS. 2 and 3 are perspective views of respective cup-shaped members of an electronics housing according to a preferred embodiment of the present invention.
Figure 3:
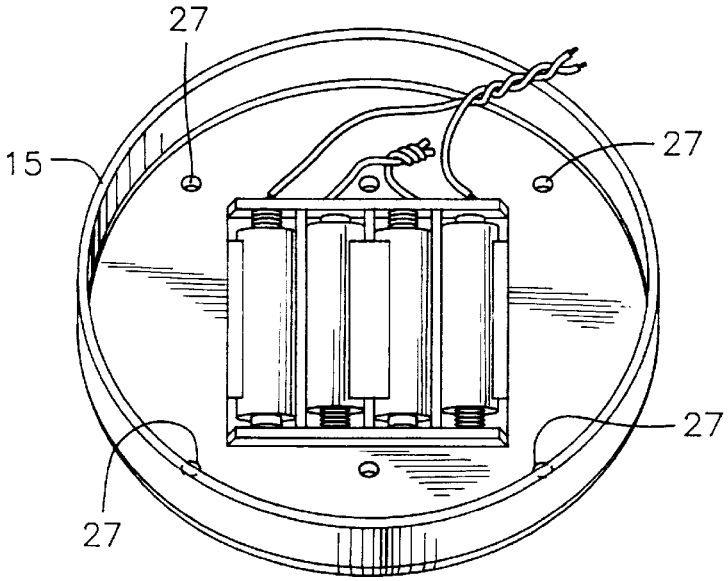

As illustrated in FIGS. 1–3, the electronics housing 12 is compact in size and preferably includes first and second cup-shaped members 13,15 which are interconnected to form a generally cylindrical enclosure. The two cup-shaped members 13,15 are readily secured together using fastening screws which extend through respective fastening holes 27 in cup-shaped member 15 into threaded engagement with internally threaded flanges 29 which project radially inwardly and upwardly from the walls of the cup-shaped member 13 to thereby secure the two cup-shaped members 13,15 to one another. The flanges 28 extend above the top edge of member 13 to serve to guide members 13 and 15 into registry with each other. Batteries 11 are preferably mounted inside the second cup-shaped member 15 and wires connect the batteries 11 to the circuit board 16.

Alternatively, the two cup-shaped members 13,15 may be secured permanently to one another using any suitable technique, such as gluing, welding, and the like. When the two cup-shaped members 13,15 are permanently secured to one another and batteries are used to power the impact sensing and sound emitting mechanism, the batteries should not be mounted inside the electronics housing 12 unless the life of the practice ball 10 is to be limited to the life of the batteries. The electronics housing 12 may be manufactured using any suitable material, including aluminum, plastic, and the like. Preferably, the electronics housing 12 includes a plurality of holes 17 in the bottom surface of the first cup-shaped member 13 to facilitate sound emission through the housing 12 from the speaker 19. The speaker 19 may be of any known manufacture and is preferably a 2½ inch mylar speaker.

The acceleration sensor 14 is responsive to acceleration of the practice ball 10. The sound generating mechanism 18, in turn, is responsive to the acceleration sensor 14 so as to emit a particular sound in response to a predetermined amount of acceleration. Preferably, the acceleration sensor 14 is a switch having at least two switching elements 28,30, each of which is responsive to a different magnitude of acceleration. The sound generating mechanism 18 is responsive to the switching elements 28,30 so as to emit different sounds depending on which of the switching elements 28,30 is/are actuated.

When the practice ball 10 is utilized, for example, to practice the art of heading a soccer ball, the switching element 28 which responds to the larger magnitude of acceleration is calibrated to activate only when the magnitude of acceleration corresponds to that which is created when the soccer ball is properly headed. The other switching element 30 is calibrated to activate when the magnitude of acceleration corresponds to at least the amount of acceleration generated when a soccer ball is improperly headed. When insufficient impact is imparted to the ball to correspond to at least the minimum amount of acceleration to activate switching element 30, no sound is emitted.

Figure 4:
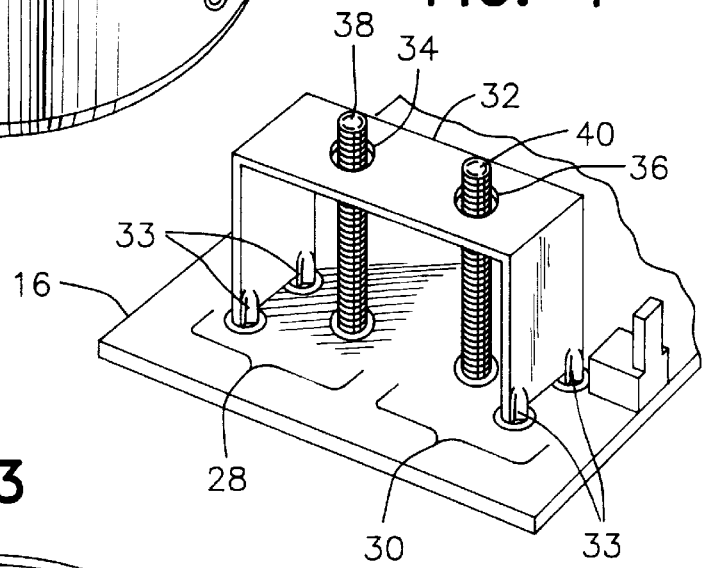
FIG. 4 is a perspective view of an acceleration sensor according to a preferred embodiment of the present invention.

With reference to FIG. 4, the acceleration sensor 14 preferably includes a conductive frame member 32 having holes 34,36 formed therein. The conductive frame member 32 defines a first electrical node which is electrically connected to the circuit board 16 of the sound generating mechanism 18, preferably to the electrical ground thereof. Although the conductive frame member 32 is preferably made of brass, it is well understood that virtually any other electrically conductive material will suffice.

Each of the switching elements 28,30 includes a spring 38,40. Each of the springs 38,40 has a distal end disposed through a respective one of the holes 34,36 in the conductive frame member 32 and a fixed proximal end electrically connected to the circuit of the circuit board 16 in the sound generating mechanism 18. Each spring 38,40 defines an additional electrical node of the acceleration sensor 14.

The holes 34,36 in the conductive frame member 32 and the springs 38,40 are arranged with respect to one another so that the springs 38,40 make electrical contact with the conductive frame member 32 only in response to different magnitudes of acceleration. Such responsiveness to different magnitudes of acceleration can be achieved by providing the holes 34,36 with different diameters, or alternatively, by using springs 38,40 having different mechanical responses to acceleration, for example different "spring constants" or the like. The preferred diameters and spring constants, of course, depend on the intended use of the practice ball 10. For example, a practice ball 10 for use in practicing the art of heading a soccer ball would require less acceleration to generate a message than a practice ball which is used as a punching bag.

The springs 38,40 are preferably parallel to one another and responsive to acceleration in any direction which is orthogonal to a longitudinal axis of each spring 38,40. Such acceleration in any orthogonal direction causes flexing of the springs 38,40, and when sufficient flexing occurs, electrical contact is established with the conductive frame member 32.

Preferably, the conductive frame member 32 includes four legs 33, each of which is bent to assume a V-shaped configuration which fits snugly into respective connection holes in the circuit board 16. It is understood that the walls of the respective connection holes include a conductive material which electrically connects the legs 33 to the circuitry of the circuit board 16. However, other convenient methods for attaching the frame member 32 to the circuit board 16 can be utilized.

When the acceleration sensor of FIG. 4 is utilized, the sound generating mechanism 18 is made responsive to electrical contact between the springs 38,40 and the conductive frame member 32 so as to produce different sounds according to which of the springs 38,40 make/makes electrical contact with the conductive frame member 32.

Figure 5:
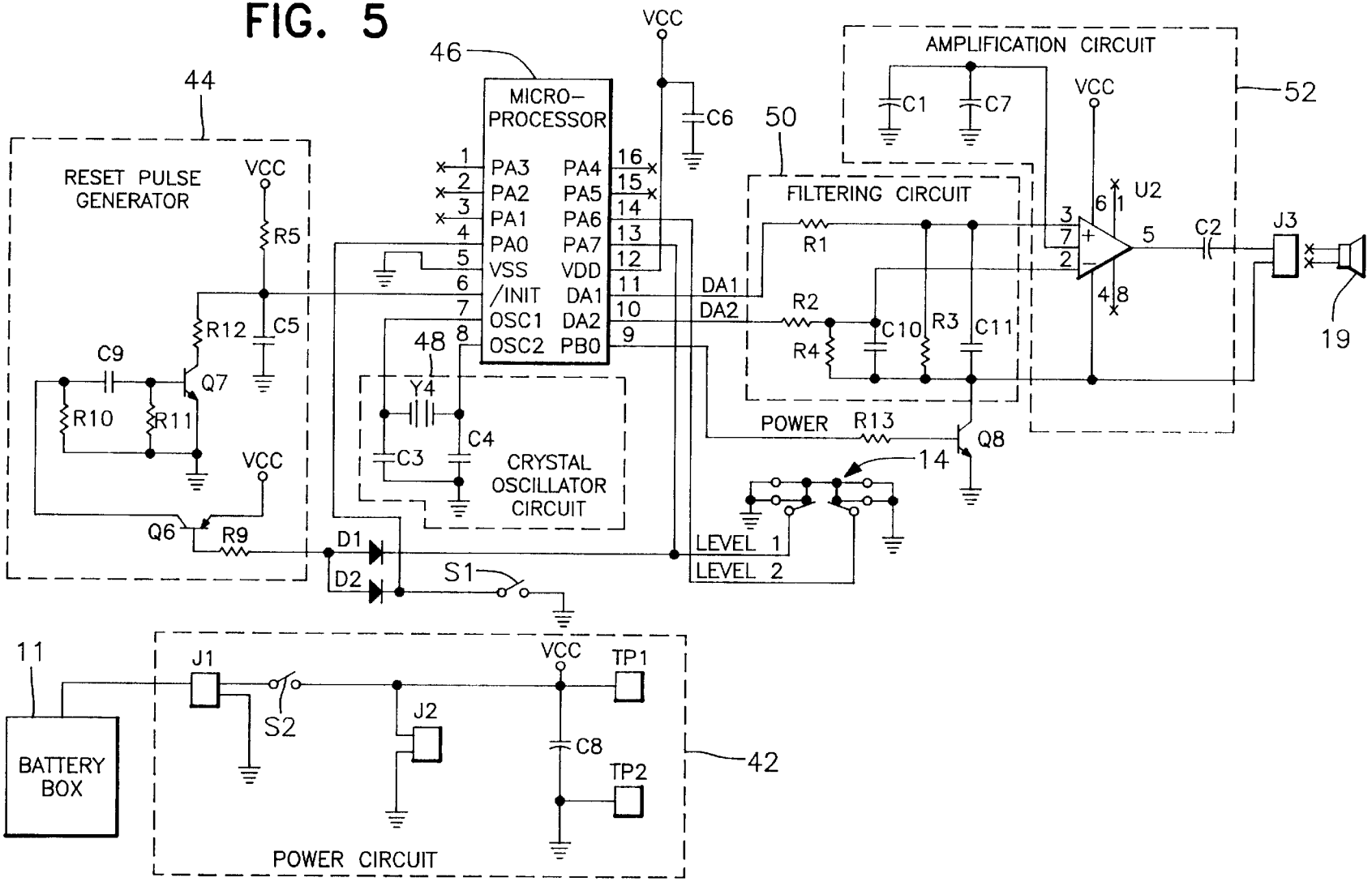
FIG. 5 is a circuit diagram illustrating a circuit arrangement in the electronics housing according to a preferred embodiment of the present invention.

A preferred circuit for placement on the circuit board 16 of the sound generating mechanism 18 is illustrated in FIG. 5. The circuit includes a voice simulation device for generating a plurality of different verbal messages in response to different accelerations of the practice ball 10. According to a preferred circuit arrangement, the voice simulation device includes a power circuit 42; a reset pulse generator 44; a microprocessor IC 46; a crystal oscillator circuit 48; a low-pass filtering circuit 50 with a cut-off frequency of approximately 3.5 kHz; an amplifier power switch Q8; an amplification circuit 52; and the speaker 19 of the sound generating mechanism 18.

The following table correlates the various illustrated circuit elements in FIG. 5 with the preferred characteristics thereof:

| REF. NO. | DESCRIPTION OF PREFERRED CIRCUIT ELEMENT |
|---|---|
| C1 | Capacitor: 10 μFarad with at least a 10 V rating |
| C2 | Capacitor: 220 μFarad |
| C3, C4 | Capacitor: 33 Pfarad |
| C5, C6, C7 | Capacitor: 0.1 μFarad |
| C8 | Capacitor: 1.0 μFarad |
| C9 | Capacitor: 0.1 μFarad |
| C10, C11 | Capacitor: 0.022 μFarad |
| J1 | Two-terminal electrical connector for electrically connecting the battery to the circuit when the slide switch is used |
| J2 | Two-terminal electrical connector for electrically connecting the battery to the circuit when the slide switch is not used |
| J3 | Two-terminal electrical connector for electrically connecting the speaker 19 to the circuit board 16 |
| D1, D2 | Diodes, preferably RLS4150 surface mounted diodes with a 1 amp rating |
| S1 | Push-button electrical switch, preferably mounted to an outside surface of the electronics housing 12 and preferably consisting of a membrane switch which closes only in response to an external force and otherwise remains open. The push-button electrical switch preferably is positioned on the housing 12 so that it can be actuated by pressing a portion of the cover 26 which bears against the switch. |
| S2 | Slide switch for selectively electrically connecting the circuitry to the power supply, the slide switch having a closed position and an open position |
| Q6 | Transistor: PNP transistor, preferably, Part No. 4403 manufactured by Motorola |
| Q7, Q8 | Transistor: NPN transistor, preferably, Part No. 4401 manufactured by Motorola |
| R1, R2 | Resistors: 47 kΩ |
| R3, R4, R9, R13 | Resistors: 2 kΩ |
| R5, R10, R11 | Resistors: 47 kΩ |
| R12 | Resistor: 470 Ω |
| 46 | Microprocessor IC: preferably, TSP50C11 microprocessor IC manufactured by and commercially available from Texas Instruments with an internal speech synthesis circuitry. The various pin designations and connections of these pins to the circuitry are illustrated. |
| U2 | Amplifier IC: preferably, LM386 amplifier IC manufactured and commercially available from National Semiconductor. The various pin designations and connections of these pins to the |

-continued

| REF. NO. | DESCRIPTION OF PREFERRED CIRCUIT ELEMENT |
|---|---|
| | circuitry are illustrated. |
| Y1 | 9.6 MHz crystal |

As illustrated in FIG. 5, two test points TP1,TP2 are provided for monitoring the voltage Vcc across the circuit. These test points TP1,TP2 are merely optional and therefore may be omitted in a commercial embodiment of the invention. Likewise, the slide switch S2 may be omitted so that voltage from the battery box 11 is constantly applied to the circuitry illustrated in FIG. 5. When such an arrangement is used and the practice ball 10 is not in use, the microprocessor 46 is programmed to assume a STANDBY mode during which only a minimal amount of power is required. The drain on the batteries is therefore insignificant, even though the circuitry remains electrically connected to the battery box 11.

In the STANDBY mode, the circuitry illustrated in FIG. 5 draws less than 10 micro-amps of current. A single 6 volt battery arrangement consisting of 4 AAA alkaline batteries therefore is capable of providing enough power to maintain the STANDBY mode for at least 110,000 hours and is also capable of emitting approximately 39,600 messages. When 4 AAA heavy-duty zinc batteries are substituted for the alkaline batteries (to reduce cost), there is enough energy to maintain the STANDBY mode for at least 66,000 hours and enough energy to generate 23,000 messages.

With such low levels of power consumption, it is commercially feasible to manufacture and sell the practice ball 10 with a permanently closed version of the electronics housing 12 so that the life of the practice ball 10 is limited to the life of the batteries. Such an arrangement advantageously permits the manufacturing and commercialization of the practice ball 10 without having to provide subsequent access to the electronics housing 12 through the soft shell 20. Thus, the cover 26 may be permanently glued into the soft shell 20 or otherwise formed integrally therewith.

Figure 6:
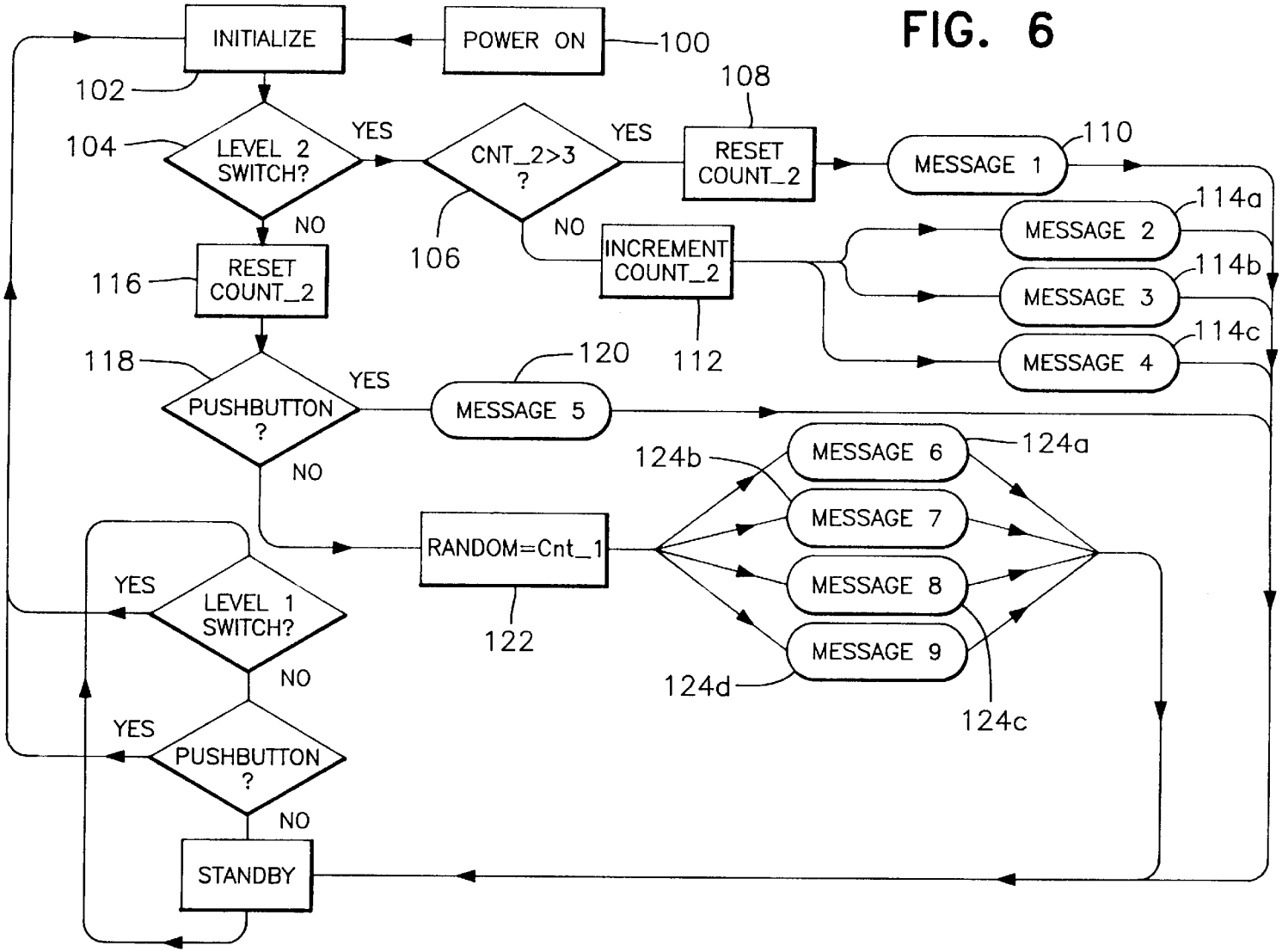
FIG. 6 is a flow chart which illustrates a preferred operation of the circuitry illustrated in FIG. 5.

Preferably, the microprocessor 46 of the voice simulation device is programmed to carry out the steps illustrated in the flow chart of FIG. 6. Although the flow chart includes some assembly language instructions, it is readily understood that any other suitable programming language may be utilized depending on the capabilities of the particular microprocessor utilized.

Initially, when battery power is applied to the microprocessor 46 (step 100), an initialization process (step 102) is carried out. Such initialization processes are generally known and include resetting of the microprocessor's internal RAM.

Next, the microprocessor 46 checks its PA6 terminal to determine whether the PA6 terminal has been grounded by one of the switching elements 28,30 (step 104). Of the two switching elements 28,30 in the acceleration sensor 14, the PA6 terminal is connected to the switching element 28 which responds to the larger magnitude of acceleration (hereinafter "level 2" acceleration). The PA6 terminal is therefore grounded only when the larger magnitude of acceleration is achieved.

If the PA6 terminal is grounded, the microprocessor 46 checks one of its internal memory locations CNT_2 in RAM to determine whether the value stored therein is greater than three (step 106). If this value is greater than three, then the microprocessor 46 determines that the previous three consecutive accelerations have reached or exceeded the level 2 acceleration. The microprocessor 46 therefore resets the value in the internal memory location CNT_2 to one (step 108), and a first predetermined message is verbally delivered via the filtering circuit 50, amplification circuit 52 and the speaker 19 (step 110). Preferably, the first predetermined message is "Goal!", with a long and drawn out pronunciation and Spanish accent which simulates a famous World Cup soccer announcer.

If the PA6 terminal is grounded, but the value in the memory location CNT_2 is not greater than three, then the memory location CNT_2 is incremented (step 112) and one of a second, third, and fourth predetermined messages is verbally emitted via the filtering circuit 50, amplification circuit 52 and the speaker 19 (step 114*a*, 114*b*, or 114*c*). Each of the second, third, and fourth messages indicates to the user that the practice ball 10 was hit hard enough to achieve the level 2 acceleration. Preferably, the second predetermined message is "Great" (pronounced Ga-RR-ate! and lasting approximately 1 second). The third predetermined message is preferably "fantastic" (pronounced FF-an-TAstic! and lasting approximately 1.5 second). And, the fourth predetermined message is preferably "awesome" (pronounced AAW-some! and lasting approximately 1 second). The order of the second, third, and fourth messages may be determined by the value in the memory location CNT_2, or alternatively, the second, third or fourth message may be randomly selected using the microprocessor 46 and one of various microprocessor-based random selection techniques which are generally known.

After any one of the first, second, third or fourth messages is verbally delivered, the microprocessor 46 switches the circuitry to the STANDBY mode during which power consumption is significantly reduced.

If, however, the microprocessor 46 determines in step 104 that the PA6 terminal is not grounded (i.e, the level 2 acceleration was not achieved), then the value stored in the internal memory location CNT_2 is reset to one (step 116). Next, the microprocessor 46 checks the push-button switch S1 to determine whether the switch S1 is closed (step 118).

If the switch S1 is closed, then a fifth predetermined message is verbally emitted via the filtering circuit 50, amplification circuit 52 and the speaker 19 (step 120). Preferably, the fifth predetermined message simulates a bugle playing a "charge" theme, followed by the trade name of the practice ball 10, for example, "HEAD COACH". Thereafter, the microprocessor 46 returns to the STANDBY mode.

If the switch S1 is open during step 118, then one of a sixth, seventh, eighth and ninth predetermined messages is emitted via the filtering circuit 50, amplification circuit 52 and speaker 19. Each of the sixth through ninth messages signifies that, although the practice ball 10 was accelerated with sufficient magnitude to trigger a most responsive of the switching elements 28,30, the magnitude of acceleration did not reach the desired level 2 acceleration. Preferably, the sixth predetermined message is "Duh", using a pronunciation which simulates the voice of Cartoon Character Bart Simpson. The seventh predetermined message is preferably "Try Again!"; the eighth predetermined message is "Higher"; and preferably, the ninth predetermined message is "Harder", all of which last approximately 1 second.

As indicated by step 122, when the switch S1 is not depressed in step 118, the microprocessor 46 preferably inserts a randomly selected numerical value in another internal memory location CNT_1 in RAM. The randomly selected number is selected from a group of numbers wherein each number corresponds to a particular one of the sixth through ninth predetermined messages. This random selection therefore randomly determines which of the sixth through ninth predetermined messages is delivered in steps 124*a*–124*d*.

Alternatively, the internal memory location CNT_1 may be incremented after delivery of each of the sixth through ninth messages in a repeating order. According to this alternative arrangement, the repetition could be provided by resetting the CNT 1 memory location after the value stored therein reaches a predetermined maximum number.

Whenever the microprocessor 46 is in the STANDBY mode, the PA0 and PA7 terminals are continuously monitored to determine whether the voltage on these terminals drops to ground. Since the PA0 terminal is connected to the push-button switch S1 and the PA7 terminal is connected to the most responsive of the switching elements 28,30, the microprocessor 46 will "wake-up" from the STANDBY mode only if one of two events occur (other than power failure). The first event is activation of the push-button switch S1 and the other event is acceleration of the practice ball 10 with sufficient magnitude to actuate the most responsive of the switching elements 28,30. Either of these events will cause the microprocessor 46 to re-initialize itself and perform the aforementioned operations beginning with step 104.

According to the flow chart, one of the sixth through ninth messages is emitted immediately after power is initially applied to the microprocessor 46 so long as the least responsive of the switching elements 28,30 is not activated, nor is the push-button switch S1 activated. In particular, upon initially receiving power, the microprocessor 46 performs step 102, step 104, step 116, step 118, step 122 and one of steps 124*a*–124*d*. When the practice ball 10 is configured with a permanently closed electronics housing, the step of powering on the microprocessor 46 occurs only during manufacturing. Therefore, the extraneous sixth, seventh, eighth or ninth message occurs only during manufacturing.

By using the circuitry illustrated in FIG. 5 and operating according to FIG. 6, the practice ball 10 is able to distinguish between accelerations thereof associated with an improperly headed soccer ball and accelerations associated with a properly headed soccer ball. The practice ball 10 is therefore able to selectively emit different messages depending on whether the practice ball is properly headed or improperly headed.

As illustrated in FIG. 1, the practice ball 10 preferably includes a tether line 70 connected to and supporting the electronics housing 12. Preferably, the tether line 70 passes through a narrow slit 72 in the soft shell 20 and thereby supports the soft shell 20 via its passage through the soft shell 20 and by virtue of a snug fit of the electronics housing 12 within the lower portion of the soft shell 20.

The tether line is preferably attached to the electronics housing 12 so as to extend in a direction perpendicular to a top surface of the conductive frame member 32. In this way, the practice ball 10 is made sensitive to accelerations in any direction perpendicular to the tether line 70.

The tether line 70 is preferably a ¾ inch polyester strap arranged so as to form a loop 73. The loop 73 preferably includes a buckle arrangement and/or hook-and-loop fasteners which render the length of the loop 73 adjustable.

It is emphasized that the foregoing description of preferred embodiments is merely exemplary and that many modifications may be made without departing from the scope and spirit of the present invention. For example, the electronics housing 12 may have an outer surface which is positioned at the outer surface 24 of the soft shell 20 and which is pentagonally or hexagonally shaped to match a soccer ball pattern on the outer surface 24 of the soft shell 20.

Further, the soft shell 20 could be replaced by a more rigid structure or skin close to the feel of a soccer ball and the impact sensing and sound emitting mechanism could be retained within the shell by rigid mounting projections on housing 12 embedded with the shell material, or other mounting techniques. In addition, the electronics housing 12 may be connected to the tether line via the pentagonally or hexagonally shaped outer surface of the electronics housing. Therefore, it is not intended to limit the present invention to the embodiment disclosed, but rather is limited only by the full scope of the invention as described and claimed.

We claim:

1. A practice ball responsive to acceleration which comprises:

a shell having a shape which simulates a sports ball;

an electronics housing positioned in said shell;

a tether line connected to said electronics housing;

an impact sensor mounted to said electronics housing and responsive to impact imparted to the practice ball and to forces imparted through said tether line; and a sound generator mounted to said electronics housing and responsive to said impact sensor for emitting a programmed sound in response to a predetermined amount of acceleration.

2. The practice ball of claim 1, wherein said impact sensor is an acceleration sensor responsive to acceleration imparted to said ball and said sound generator is responsive to said acceleration sensor.

3. The practice ball of claim 1, wherein said shell comprises a ball of deformable cellulous material having a cavity in an outer surface thereof, said cavity and said electronics housing frictionally having dimensions such that said electronics housing fits and is retained in said cavity.

4. The practice ball of claim 3, wherein a surface of said electronics housing has an open-cell cellulous covering which matches said outer surface shape.

5. The practice ball of claim 1, wherein said shell comprises a polyurethane foam ball having a cavity in an outer surface thereof, said cavity and said electronic housing having dimensions such that said electronics housing fits frictionally and is retained in said cavity.

6. The practice ball of claim 1, wherein said impact sensor includes at least two switching elements, each of which is responsive to a different magnitude of impact, and wherein said sound generator is responsive to said at least two switching elements so as to emit different programmed sounds depending on which of said at least two switching elements is/are actuated.

7. The practice ball of claim 6, wherein said impact sensor is an acceleration sensor which includes:

a conductive frame member having holes therein, said conductive frame member being electrically connected to said sound generating means;

said at least two switching elements include springs, each of said springs having a distal end disposed through a respective one of said holes in said conductive frame member and a fixed proximal end electrically connected to said sound generating means;

said holes in the conductive frame member and said springs are arranged with respect to one another so that said springs make electrical contact with said conductive frame member only in response to different magnitudes of acceleration; and said sound generator is responsive to electrical contact between said springs and said conductive frame member so as to produce different sounds according to which of said springs makes the electrical contact with said conductive frame member.

8. The practice ball of claim 6, wherein said sound generator includes a voice simulation device and said different sounds are verbal messages.

9. The practice ball of claim 1, wherein said electronics housing supports said shell by virtue of a frictional fit in said shell.

10. The practice ball of claim 1, wherein said sound generator includes a voice simulation device and said programmed sound is a verbal message.

11. The practice ball of claim 1, further comprising an opening at one end of the shell and a slit extending through said shell from the opening to an opposite end of the shell, the tether line extending through said slit.

12. A practice ball responsive to acceleration during use in practicing sports, said practice ball comprising:

a simulated sports ball having a cavity therein;

an acceleration sensor mounted in said cavity and responsive to acceleration of the practice ball, said acceleration sensor including at least two switching elements, each of which is responsive to a different magnitude of acceleration; and a sound generator also mounted in said cavity and responsive to said at least two switching elements so as to emit different programmed sounds depending on which of said at least two switching elements is/are actuated.

13. The practice ball of claim 12, wherein said simulated sports ball comprises a ball of deformable cellulous material and includes an electronic housing for mounting said acceleration sensor and said sound generator therein, said cavity and said electronics housing having dimensions such that said electronics housing fits frictionally and is retained in said cavity.

14. The practice ball of claim 13, wherein a surface of said electronics housing has an open-cell cellulose covering which matches said outer surface of said ball.

15. The practice ball of claim 13, wherein said simulated sports ball comprises a polyurethane foam ball.

16. The practice ball of claim 12, wherein:

said acceleration sensor includes a conductive frame member having holes therein, said conductive frame member being electrically connected to said sound generating means;

said at least two switching elements include springs, each of said springs having a distal end disposed through a respective one of said holes in said conductive frame member and a fixed proximal end electrically connected to said sound generating means;

said holes in the conductive frame member and said springs are arranged with respect to one another so that said springs make electrical contact with said conductive frame member only in response to different magnitudes of acceleration; and said sound generator is responsive to electrical contact between said springs and said conductive frame member so as to produce different sounds according to which of said springs makes electrical contact with said conductive frame member.

17. The practice ball of claim 12, wherein said sound generator includes a voice simulation device and said different sounds are verbal messages.

18. The practice ball of claim 13, further comprising a tether line adapted for connection to said electronics housing so that said electronics housing is supported by said tether line, and wherein said electronics housing supports said simulated sports ball by virtue of said frictional fit therein.

19. The practice ball of claim 12, further comprising an opening at one end of the shell, a slit extending through said shell from the opening to an opposite end of the shell, and a tether line connected to said electronics housing and extending through said slit.

20. A soccer practice device for practicing the art of heading, said soccer practice device comprising:

a deformable simulated soccer ball having a cavity therein and suspended by a tether line;

a rigid electronics housing positioned in said cavity;

an impact sensor mounted to said electronics housing and responsive to impact imparted to said ball, said sensor including at least two switching elements, each of which is responsive to a different magnitude of impact; and a battery-powered sound generator mounted to said electronics housing and responsive to said at least two switching elements so as to emit different programmed sounds depending on which of said at least two switching elements is/are actuated.

21. The soccer practice device of claim 20 wherein said impact sensor is an acceleration sensor responsive to acceleration imparted to said ball and said sound generator is responsive to said acceleration sensor.

22. The soccer practice device of claim 20 wherein said impact sensor, said sound generator and batteries for powering said sound generator are all mounted within said electronics housing.

23. The soccer practice device of claim 22, wherein said tether line is connected to said electronics housing so that said electronics housing is supported by said tether line, and said electronics housing supports said simulated soccer ball by virtue of a frictional fit thereon;

said acceleration sensor includes a conductive frame member having holes therein, said conductive frame member being electrically connected to said sound generating means;

said at least two switching elements include springs, each of said springs having a distal end disposed through a respective one of said holes in said conductive frame member and a fixed proximal end electrically connected to said sound generating means;

said holes in the conductive frame member and said springs are arranged with respect to one another so that said springs make electrical contact with said conductive frame member only in response to different magnitudes of acceleration; and said sound generator is responsive to electrical contact between said springs and said conductive frame member and includes a voice simulation device so as to produce different verbal messages according to which of said springs makes electrical contact with said conductive frame member when the simulated soccer ball is rapidly accelerated.

24. The practice ball of claim 20, further comprising an opening at one end of the shell, a slit extending through said shell from the opening to an opposite end of the shell, and a tether line connected to said electronics housing and extending through said slit.

25. An acceleration sensor for detecting at least two different magnitudes of acceleration, said acceleration sensor comprising:

a conductive frame member having holes therein, said conductive frame member defining a first electrical node of the acceleration sensor; and at least two switching elements, each of which is responsive to a different magnitude of acceleration, said at least two switching elements including springs, each of said springs having a distal end disposed through a respective one of said holes in said conductive frame member and a fixed proximal end, each of said springs defining an additional node of the acceleration sensor;

said holes in the conductive frame member and said springs being arranged with respect to one another so that said springs make electrical contact with said conductive frame member only in response to different magnitudes of acceleration.

26. The acceleration sensor of claim 22, wherein said springs are substantially parallel to one another and responsive to acceleration in any direction which is orthogonal to a longitudinal axis of each spring.

27. A practice ball responsive to acceleration which comprises:

a shell having a shape which simulates a sports ball;

an electronics housing positioned in said shell;

at least one impact sensor mounted to said electronics housing and responsive to different magnitudes of impact imparted to the practice ball; and a sound generator mounted to said electronics housing and responsive to said at least one impact sensor for emitting a first programmed sound in response to an impact that is greater than a first predetermined magnitude and a second programmed sound in response to an impact that is greater than a second predetermined magnitude.

* * * * *